US005954440A

United States Patent [19]

Leys et al.

[11] Patent Number: 5,954,440

[45] **Date of Patent: *Sep. 21, 1999**

[54] THERMAL PRINTER WITH SHEET PRESSURE MEANS

[75] Inventors: Paul Leys, Kontich; Daniel Verbeek, Heis-op-den Berg, both of Belgium

[73] Assignee: Agfa-Gevaert, Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/977,995

[22] Filed: Nov. 25, 1997

Related U.S. Application Data

[60] Provisional application No. 60/036,809, Feb. 3, 1997.

[30] Foreign Application Priority Data

Nov. 28, 1996 [EP] European Pat. Off. ..... 96203361

[51] Int. Cl.[6] ..... B41J 13/10

[52] U.S. Cl. ..... 400/645; 400/636.1

[58] Field of Search ..... 400/645, 636.1, 400/636, 624, 625

[56] References Cited

U.S. PATENT DOCUMENTS

| | | | |
|---|---|---|---|
| 4,500,219 | 2/1985 | Lange et al. | 400/645 |
| 4,739,341 | 4/1988 | Matsuno et al. | 400/636 |
| 4,883,375 | 11/1989 | Karube et al. | 400/636.1 |
| 4,996,537 | 2/1991 | Kishimi | 346/1.1 |
| 5,209,590 | 5/1993 | Tsukuda et al. | 400/636.1 |
| 5,244,295 | 9/1993 | Terashima et al. | 400/645 |
| 5,378,071 | 1/1995 | Uehara | 400/636.1 |

FOREIGN PATENT DOCUMENTS

| | | |
|---|---|---|
| 0435409 | 12/1990 | European Pat. Off. . |
| 0543150 | 5/1993 | European Pat. Off. . |
| 0691208 | 7/1995 | European Pat. Off. . |
| 60-131278 | 11/1985 | Japan . |
| 60-179276 | 1/1986 | Japan . |

*Primary Examiner*—Edgar Burr
*Assistant Examiner*—Anthony H. Nguyen
*Attorney, Agent, or Firm*—Baker & Botts, L.L.P.

[57] ABSTRACT

Thermal printer with a thermal head (16) for image-wise heating a heat-sensitive sheet (38) according to an elongate printing zone, transverse with respect to the sheet, and a rotatable print drum (15) for conveying such sheet past such thermal head while the head is urged towards the drum, which is provided with a pressure roller (17) for urging a sheet section, downstream of the printing zone, onto the print drum in order to establish a contact angle alpha between the sheet and the print drum. (FIG. 5)

12 Claims, 6 Drawing Sheets

THERMAL PRINTER WITH SHEET PRESSURE MEANS

This application claims benefit of Provisional Application Ser. No. 60/036,809, filed Feb. 3, 1997.

BACKGROUND OF THE INVENTION

1. Field of the invention

The present invention relates to a thermal printer with a thermal head for line-wise heating a heat-sensitive sheet to produce an image, in particular an image on a transparent support for medical diagnostic purposes.

2. Description of the Prior Art

Thermal imaging or thermography is a recording process wherein images are generated by the use of image-wise modulated thermal energy.

In thermography two approaches are known

1. Direct thermal formation of a visible image pattern by the image-wise heating of a recording material containing matter that by chemical or physical process changes colour or optical density.
2. Thermal dye transfer printing wherein a visible image pattern is formed by transfer of a coloured species from an image-wise heated donor element into a receptor element.

A survey of "direct thermal" imaging methods is given in the book "Imaging systems" by Kurt I. Jacobson-Ralph E. Jacobson, The Focal Press—London and New York (1976), Chapter VII under the heading "7.1 Thermography".

Common thermal printers comprise a rotatable drum and an elongate thermal head which is spring-biased towards the drum to firmly line-wise contact a heat-sensitive material which is passed between the head and the drum.

The thermal head includes a plurality of heating elements and corresponding drivers and shift registers for these elements. The image-wise heating of a sheet is performed on a line by line basis, with the heating resistors geometrically juxtaposed along each other in a bead-like row running parallel to the axis of the drum. Each of these resistors is capable of being energised by heating pulses, the energy of which is controlled in accordance with the required density of the corresponding picture element.

In thermal dye transfer the sheet, i.e. the image receiving sheet, is attached to the rotatable drum, and a dye donor sheet or web is conveyed by frictional contact with the rotating sheet past the thermal head.

In direct thermal image formation, a single heat-sensitive sheet is conveyed between the thermal head and the drum, and the image is directly produced in the sheet. The sheet is not attached to the drum but is advanced between the head and the drum by frictional contact of its rearside with the drum.

We have found that if the sheet transport during printing occurs by frictional contact of the rearside of the sheet with the driven print drum, only at the place of the thermal head, control of the actual speed of advance may be insufficient so that the quality of the printed thermal image may become unsatisfactory.

SUMMARY OF THE INVENTION

Object of the Invention

It is one object of the invention to provide a thermal printer for producing an image in a heat-sensitive sheet, which provides excellent control of the printing speed so that images of high quality can be produced.

It is another object of the invention to provide a thermal printer which is particularly suited for producing images on a transparent support for diagnostic purposes, medical diagnosis in particular. Examples of medical diagnosis are echograms, CT scans and NMR images. These images are negative-type images, which what means that their background is substantially black, the image details having lesser optical densities.

These images are viewed on a light box and in this connection it is a drawback that the end of the sheet which was leading during image printing is transparent because it had to be freely passed between the thermal head and the print drum before the thermal head could be closed and image-wise printing could start. Radiologists are unfamiliar with such a large open image margin, which does not exist in conventional AgX X-ray images. Moreover, such an open area has a dazzling effect. The present invention aims to provide a particular solution for the mentioned problem.

In this connection it should be noted that thermal printing on a transparent sheet, on a polyethylene terephthalate support in particular, preferably is done while keeping unprinted margins all around the sheet since the risk is great for damaging the head or reducing its lifetime by contact with the edges of a sheet. These edges are often sharp and destructive for any surface in sliding contact therewith. For that reason the width of a sheet to be printed is, in this application, slightly smaller than the length of the thermal head but the lateral sheet edges are not printed, and the head is put in contact with the sheet only after the front edge of the sheet has passed the head and is withdrawn before the trailing end of the sheet arrives. Further, the sheet is duly laterally aligned before the thermal head takes its printing position. The result of all this is a transparent marginal frame on the sheet with a uniform width which as such is not disturbing because it can be of the order of magnitude of 5 mm only.

STATEMENT OF THE INVENTION

In accordance with the present invention, a thermal printer with a thermal head for image-wise heating a heat-sensitive sheet according to an elongate printing zone, transverse with respect to the sheet, and a rotatable driven print drum for conveying such sheet past such thermal head while the head is urged towards the drum, said thermal head having a rest position remote of the print drum allowing the leading end of a sheet to pass freely between such head and drum, and an operative one in which the head is urged towards such drum, is characterised in that said printer is provided with pressure means for urging a sheet section, downstream of said printing zone, onto the print drum in order to establish a notable angular frictional contact area between the sheet and the print drum.

Said pressure means suitably has an open position remote of the print drum allowing the leading sheet end extending beyond the thermal head to extend freely between such pressure means and such drum, and a closed one in which it urges the sheet in contact with the drum.

Preferred embodiments of the invention are as follows.

The pressure means is formed by roller means which are displaceable towards said print drum in parallel relationship therewith.

The mentioned roller means comprises a plurality of axially spaced roller sections mounted for individual biasing.

The printer may comprise control means controlling the movements of the thermal head and of the pressure means in such a way that first the thermal head is moved from its rest to its operative position to engage the sheet, and next the pressure means is operated to urge the leading sheet end on the print drum. The print drum suitably is briefly rotated as the leading sheet end is introduced between the head and drum in order not to possibly hinder the sheet advance as the sheet is in frictional contact with the drum, and then the thermal head is urged towards the drum, the drum is started to advance the sheet, and the pressure means is closed to angularly deflect the sheet, in succession.

Referring to the use of a thermal printer according to the invention for the printing of images for medical diagnosis, the printer suitably is operated in such a way that, as the thermal head is in its operative position but the pressure means is still inoperative, the leading margin of the sheet is printed at a high image density, i.e. pre-printing, to avoid dazzling effects and, after the pressure means became operative, image-wise printing as such is started. In such procedure, it may be interesting to provide identification or other data on the pre-printed image margin, e.g. in the form of indicia of reduced optical density.

The present invention includes also a novel thermal print on a transparent support bearing a radiographic image. Such print is characterised thereby that it has an unprinted peripheral margin. Further, the radiographic image may have a black band on one of its side edges. This band may be provided, if desired, with identification data in the form of indicia of a lesser optical density.

BRIEF DESCRIPTION OF THE DRAWINGS

The invention will be described hereinafter by way of example with reference to the accompanying drawings, wherein.

DETAILED DESCRIPTION OF THE DRAWINGS

Figure 1:
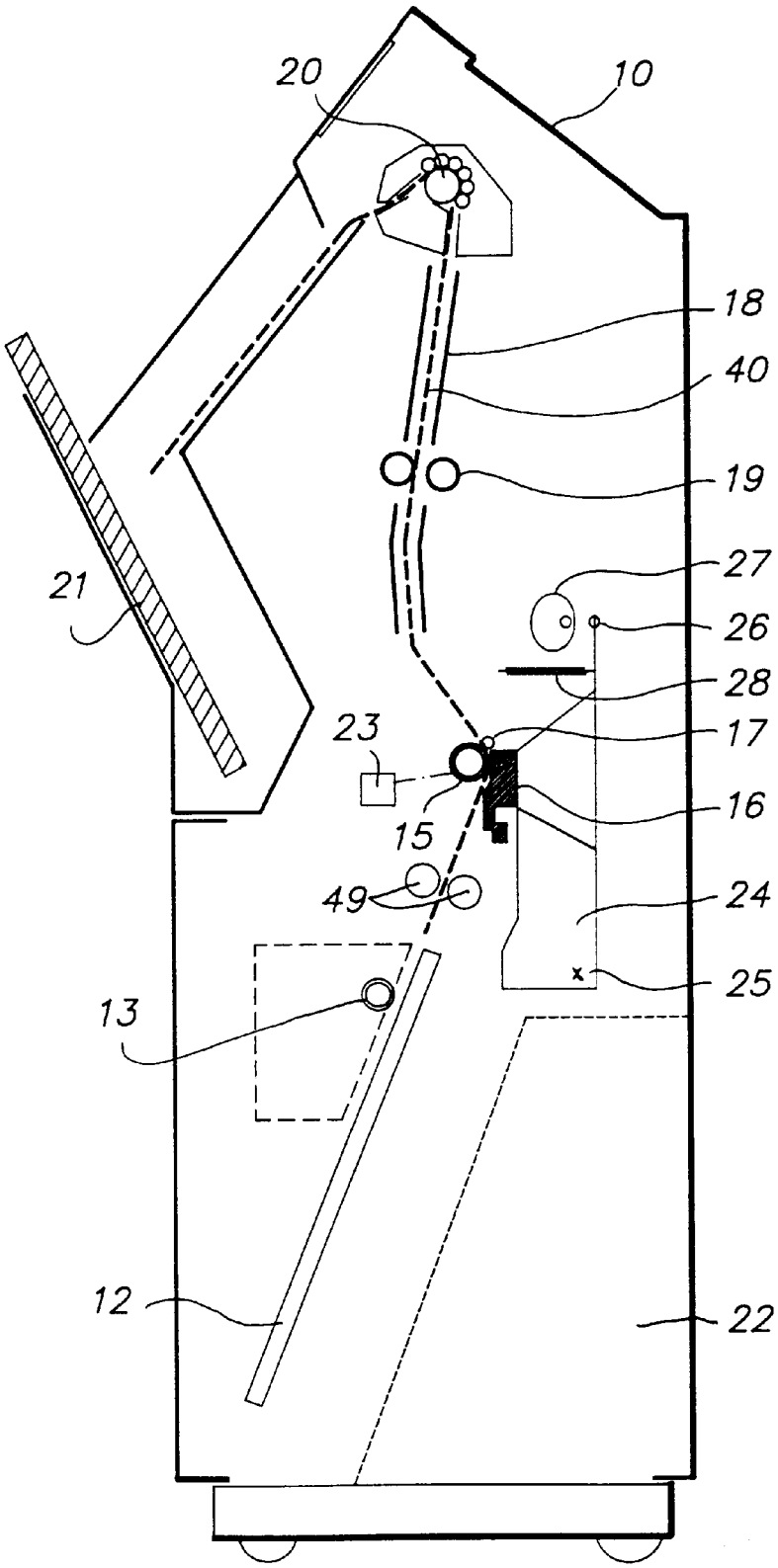
FIG. 1 is a diagrammatic view of one embodiment of a thermal printer according to the invention.

FIG. 1 shows the general layout of one embodiment of a thermal printer according to the invention.

The apparatus is mounted in a housing 10 which comprises means for holding a stack 12 of sheets to be printed in an inwardly tilted position, a dispenser roller 13 for removing the sheets one by one from the stack and for conveying them upwardly, a print drum 15 as known in the art and driven by motor 23, a thermal head 16, a sheet pressure roller 17, sheet guides 18 and sheet driving rollers 19, a de-curl roller 20, an outlet tray 21, and control means 22 for controlling image acquisition and processing. Thermal head 16 is mounted on a rigid frame 24 which is pivotable about axis 25 running strictly parallel with the print drum axis. Frame 24 bears at its free end a follower roller 26 riding on a rotatable cam 27, see FIG. 2. A tension spring 28 urges the frame in the direction of the print drum.

Pressure roller 17 is mounted for free rotation in a frame 29 which is pivotable about shaft 30 running likewise parallel to the print drum. Frame 29 bears at its free end a follower roller 31 riding on a cam 32. A tension spring 34 causes frame 29 to urge roller 17 towards the print drum. Both cams 27 and 32 are mounted in the angular relationship as shown on a common shaft 35 which is rotatable by a motor 36.

The operation of the thermal printer described hereinbefore is as follows with reference to FIG. 1 and one of the successive FIGS. 2 to 5.

Figure 2:
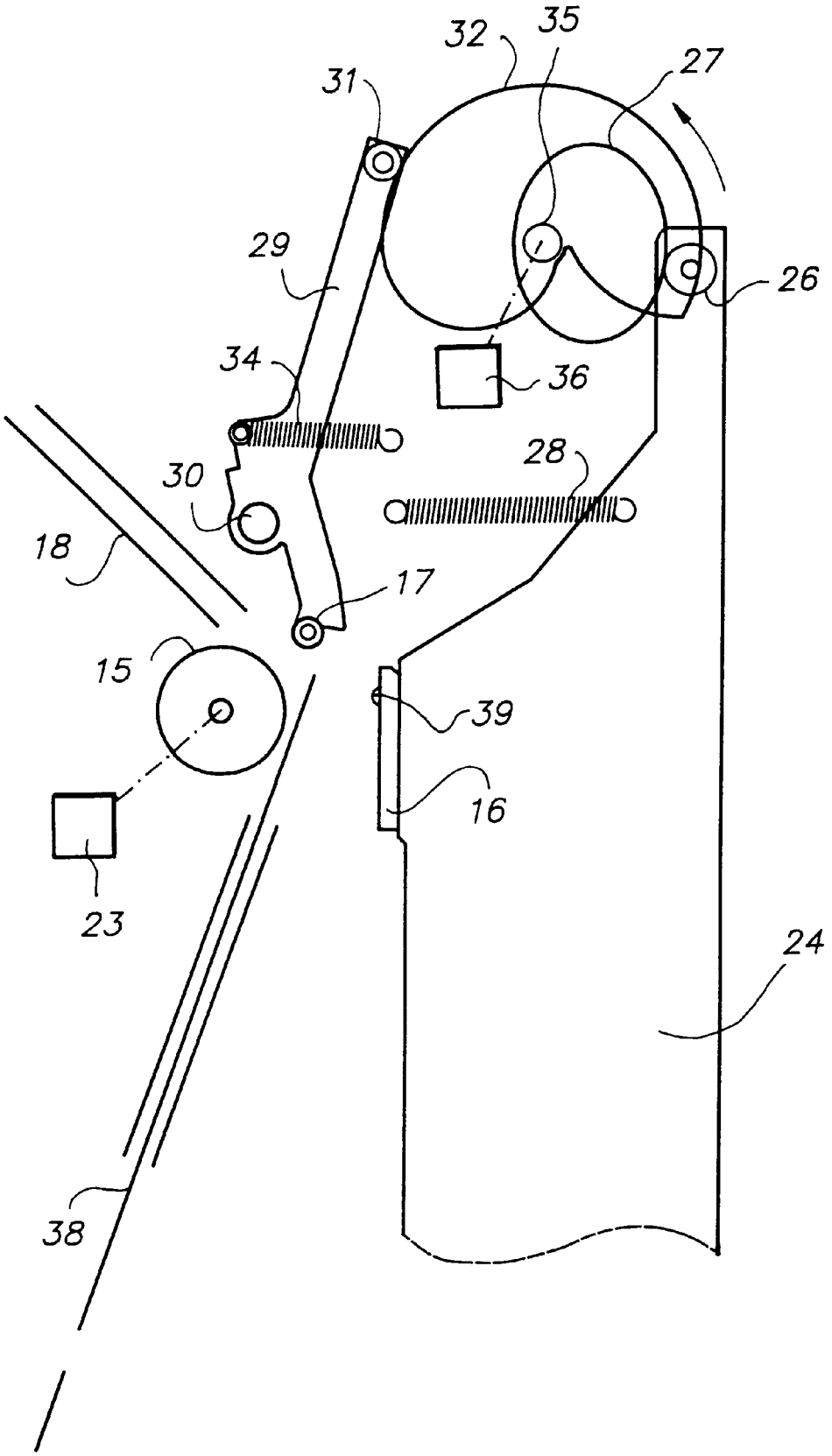
FIG. 2 is a detail view of the print head and the sheet pressure mechanism of FIG. 1, shown in the rest position.

Dispenser roller 13 is controlled to remove the upper sheet 38 from stack 12 and convey it upwardly until its leading end takes a position between print drum 15 and thermal head 16 as shown in FIG. 2.

Sheet 38 is in this example a heat-sensitive sheet having a heat-sensitive layer coated on a polyethylene terephthalate support. Suitable thermographic materials for medical imaging based on silver behenate in thermal working relationship with a reducing agent are disclosed in our co-pending patent applications EP-A-0 669 875,EP-A-0 669 876 and EP-A-0 726 852.

Figure 3:
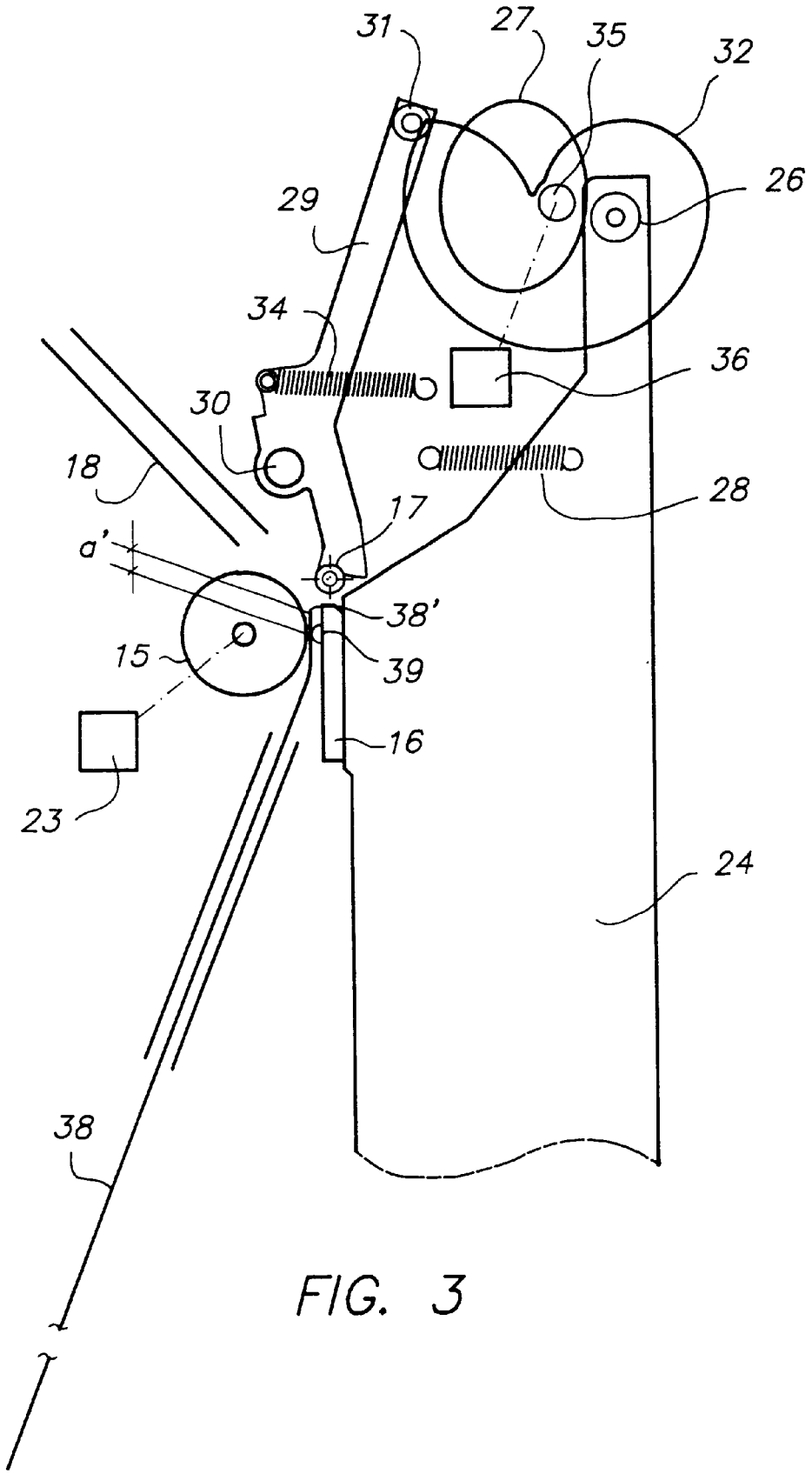
FIG. 3 is the mechanism of FIG. 2, shown in the pre-print position.

Next, motor 36 is energised to rotate the cam mechanism counter-clockwise until cam 27 takes a position as shown in FIG. 3. In this position roller 26 is free from cam 27 and thermal head 16 is with its array of printing elements 39 urged in contact with sheet 38 by spring 28. Printing array 39 slightly deflects leading end 38' of the sheet so that it extends almost vertical according to the figure. The width of unprinted leading end 38' amounts to a'.

Figure 4:
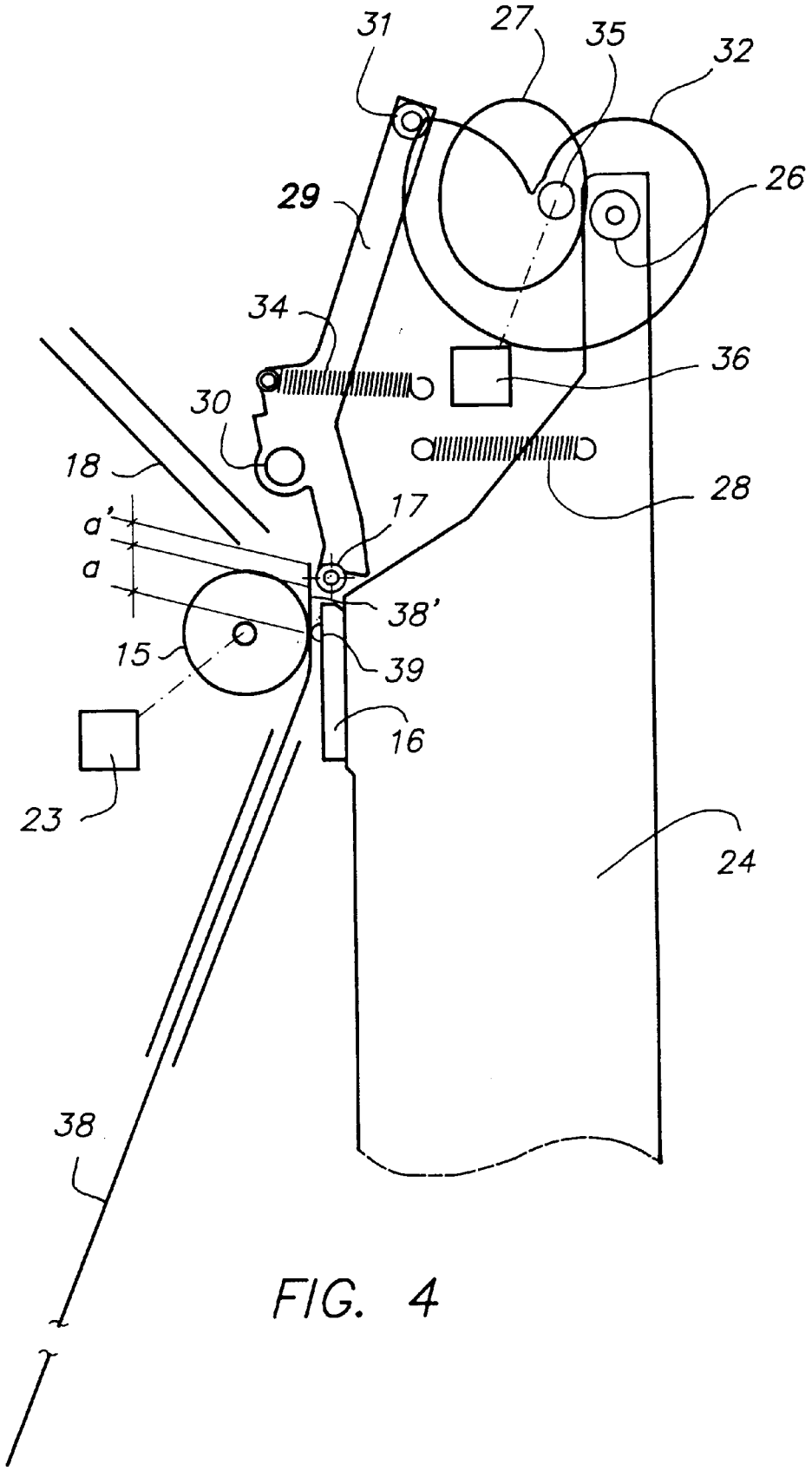
FIG. 4 shows the mechanism in the FIG. 3 position; the print drum having advanced the sheet.

Then motor 23 is energised to rotate print drum 15 over a certain angle in anti-clockwise direction so that now the size of leading end 38' of the sheet is increased until the leading edge of the sheet reaches beyond pressure roller 17, see FIG. 4. As print drum 15 started to rotate, thermal head 16 was energised to pre-print the sheet and this until the leading sheet end has increased to the size shown in FIG. 4. The described pre-printing action of the thermal head produces a black leading zone a on the sheet, except for the very leading margin a' which remains transparent since it was introduced past printing array 39 without any printing contact therewith. Black zone a is desirable for waiving the otherwise disturbing effect of a notable unprinted area of the sheet. The notion "black" stands in the present example for an optical density which equals approximately the maximum density of the radiographic image, e.g. a density of 3.0 or slightly less.

There is, however, no objection whatsoever providing this blackened zone a with identification data or the like in the form of letters, figures, lines of a barcode, etc. of reduced optical density. The reduced density of these data does not destroy the overall dark outlook of zone a. Minor speed fluctuations of the sheet as a consequence of the limited frictional contact of the sheet with the print drum during this pre-printing are not important for the quality of this part of the image information, and will mostly not even be noticed by the naked eye.

Figure 5:
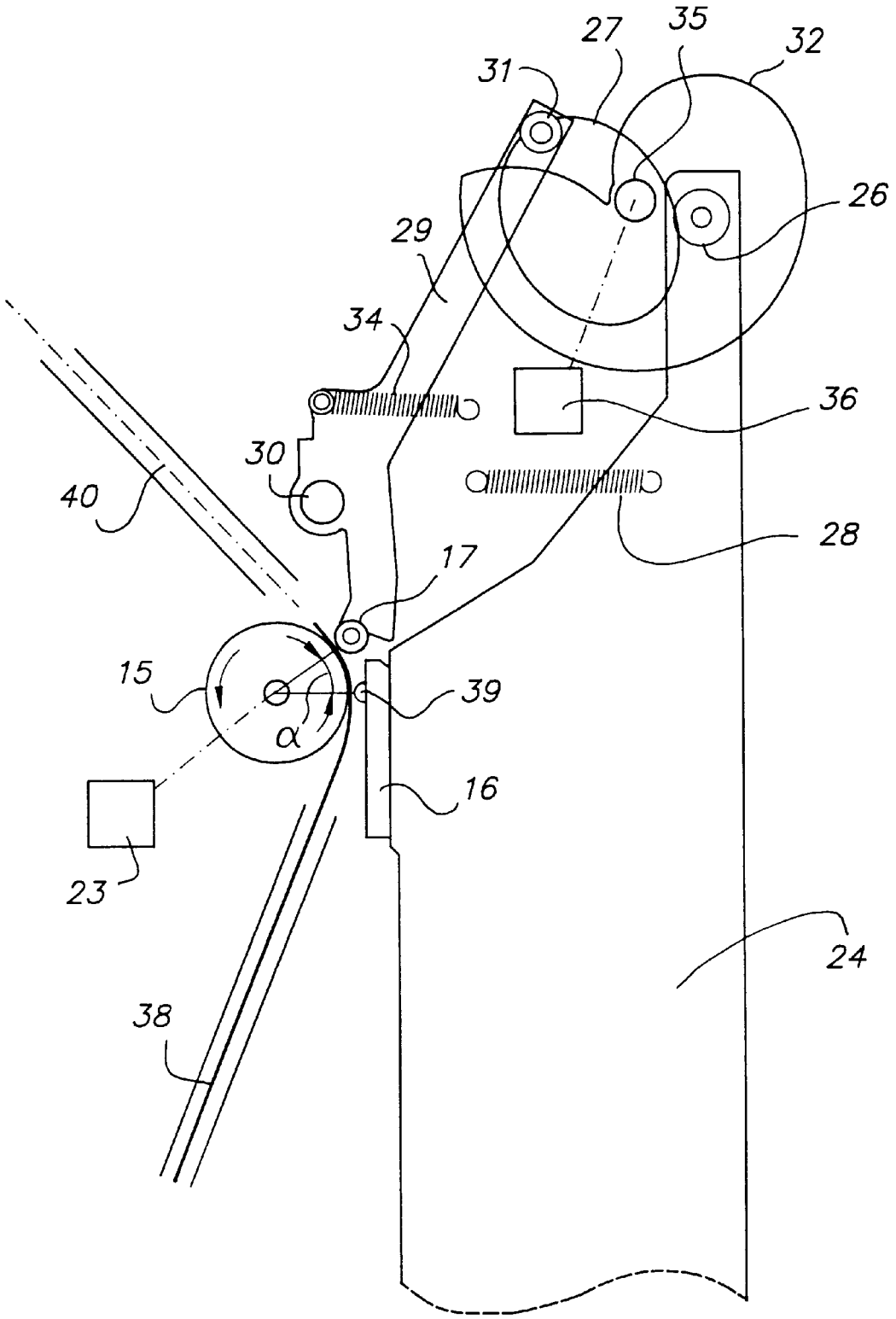
FIG. 5 shows the mechanism of FIG. 2 in the printing position.

Then motor 36 is energised again to further rotate the cam mechanism in counter-clockwise direction so that cam 32 takes a position as shown in FIG. 5 allowing spring 34 to pull pressure roller 17 against the print drum by rotation of frame 29 round shaft 30, thereby deflecting the leading end of the sheet as shown. This deflection extends over an angle $\alpha$ and provides a substantial frictional engagement of the sheet by the print drum so that now the sheet advance by the driven print drum is well under control. Image-wise printing can start up from the moment pressure roller 17 is urged against the print drum, and the apparatus suitably comprises control means for controlling the printing operation as a function of the position of this pressure roller.

As the sheet is being printed, it is conveyed along path 40 between guide plates 18 up to de-curl roller 20 surrounded by a plurality of angularly disposed sheet pressure rollers. Roller 20 is a heated roller in contact with the rear side of the sheet in order to compensate for curling stresses which have been introduced in the sheet by the image-wise heating of its front side. We refer to our co-pending application EP-A-0 679 519 wherein the uniform heating of a sheet at its rear side to reduce curling is disclosed.

In this connection it is interesting to know that it is advantageous to keep the drive of the sheet free from any disturbing influence. The driving and the machining of the de-curl roller are in principle less accurate than those of the print drum and therefore it is desirable that the sheet drive of roller 20 not be allowed to interfere with that of drum 15. The length of the sheet path between 15 and 20 is larger than the length of the largest sheet to be printed in the apparatus, and the sheet transport between both said rollers can occur by driven pressure rollers 19 taking an open position as shown in FIG. 1, and being closed as the last image line on the sheet has been printed to take over the sheet drive from the print drum before the trailing sheet edge passes beyond printing array 39.

No details have been given hitherto about pressure roller 17. While this may be a simple cylindrical metal roller covering the full width of the print drum, we have found that the precision of such roller should meet high standards in order to avoid damaging the newly printed image and/or disturbing the correct sheet drive.

Figure 6:
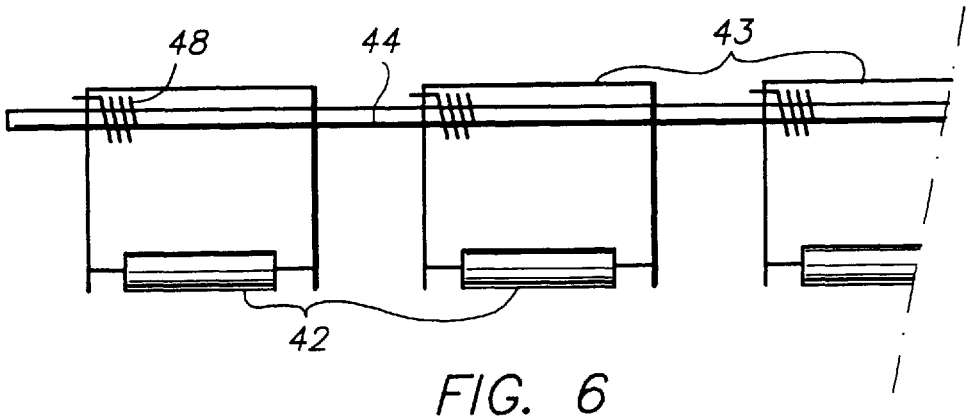
FIG. 6 shows a detail of one embodiment of the sheet pressure means.

Therefore, a suitable embodiment of this roller is one which is composed of a plurality of roller sections 42 mounted for free rotation in yokes 43 pivotally mounted on a stationary shaft 44 which is fitted in frame 29 and which bears helical springs 48 for individually biasing each roller section towards the print drum. We refer to FIG. 6 showing a plan view of suchlike arrangement. The roller sections can be made from a suitable plastic.

The following example illustrates the thermal printer and the image described hereinbefore.

| | |
|---|---|
| Print drum 15: | length: 360 mm<br>diameter: 35 mm |
| Pressure roller 17: | composed of 5 roller sections, each having a length of 15 mm, a diameter of 8 mm, and made of silicone rubber |
| Angle α: | 38.0 degrees |
| Angular contact distance: | 10 mm |
| Printed sheet: | a: 10 mm<br>a': 5 mm |

Figure 7:
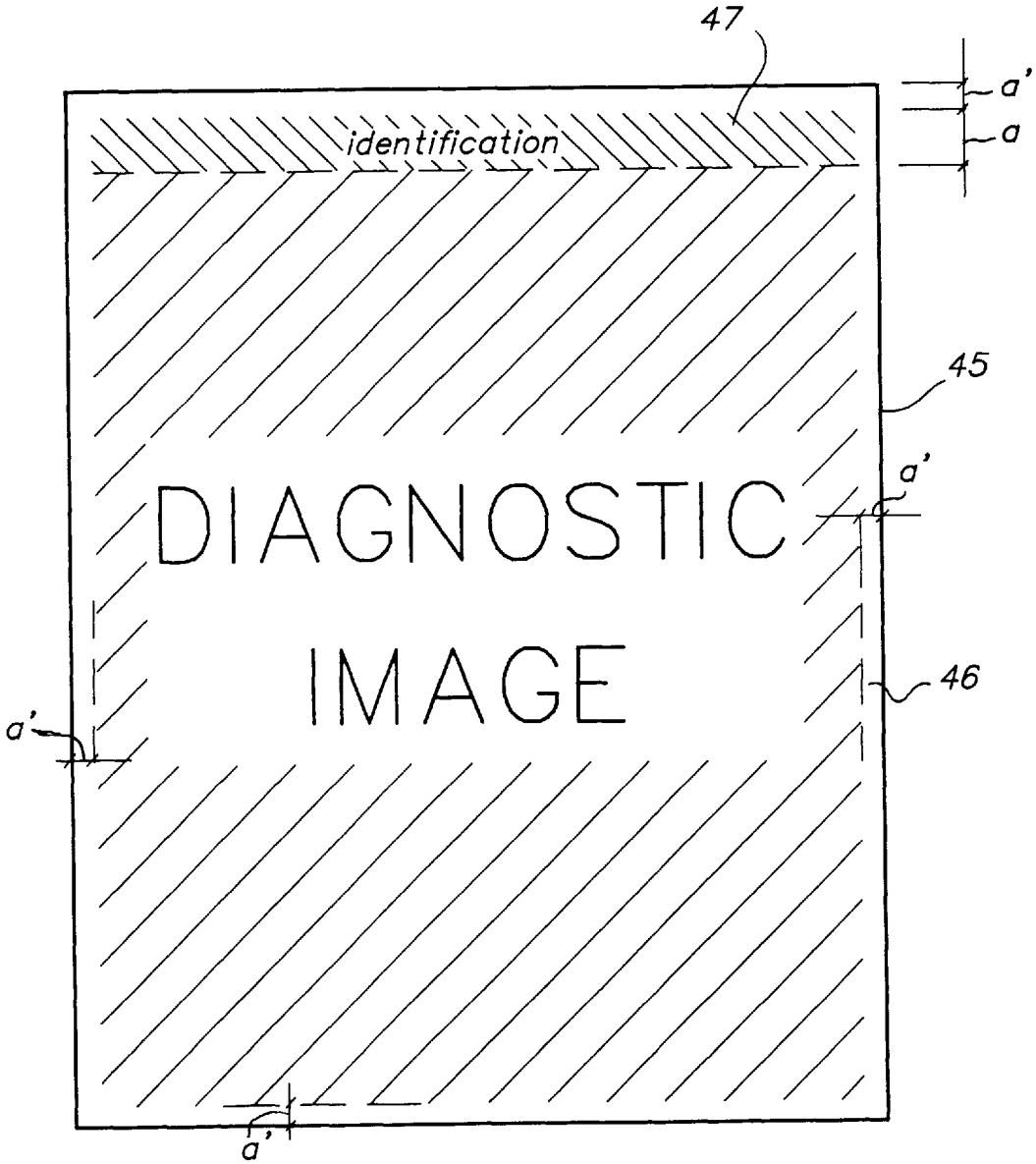
FIG. 7 shows an example of a printed sheet.

FIG. 7 shows an example of the image on a thermal-sensitive sheet printed with the thermal printer according to the invention. Polyethylene terephthalate sheet 45 has a transparent circumferential margin 46 with a width a' . The leading end of the sheet bears a black band 47 with a width a.

A printer according to the present invention is not limited to the described embodiment.

The bodily displacement of the pressure means may occur by other mechanisms known in the art.

The pressure means may comprise a second roller, or combination of roller sections, which is located angularly (with respect to the print drum) after a first pressure roller so as to obtain a larger angle of wrapping of the sheet about the print drum. Such second roller(s) can be moved simultaneously with, or with a small delay with respect to, the first pressure roller.

The sheet advance over distance a before the pressure means are closed may be smaller than 10 mm and may suitably start up from 5 mm.

The feeding of a sheet taken from a stack of sheets into the gap between print drum and thermal head can occur in various ways.

The description hereinbefore remained silent about the way the exact length a' of the leading sheet end is set prior to closing the print head.

A particularly interesting mechanism for obtaining this result is one based on the use of gravity to let a sheet, which has been forwarded upwardly beyond its intended position, fall back with its trailing edge on a reference stop, adjustable as the case may be. This arrangement provides under all circumstances a reliable sheet positioning, and is disclosed in our co-pending European patent application No. 96 20 3359,filed on even day herewith, that is, on Nov. 28, 1996. This arrangement may occasionally comprise additional sheet driving rollers such as 49, see FIG.1, for moving a sheet slighly backwardly.

A sheet pack which is particularly suited for loading a stack of sheets in a tilted position as shown in FIG.l, without risk for the stack of sheets to become disturbed as it is put in the magazine of the printer, is disclosed in our co-pending European patent application No. 96 20 3360, filed on even day herewith, that is, on Nov. 28, 1996.

The pivoting of frame 24 carrying thermal head 16 has been described as occurring around axis 25. We have found that the exact location of print elements 39 with respect to the print drum is of uttermost importance for avoiding a defect known as "banding" and for that reason it may be desirable to provide adjustment means for finely tuning the position of this axis. We refer to our co-pending application EP-A-0 806 298 wherein a novel adjustment mechanism for this purpose has been disclosed.

Parts List

10 housing
12 stack
13 dispenser roller
15 print drum
16 thermal head
17 pressure roller
18 guides
19 driving rollers
20 decurling roller
21 outlet tray
24 frame
25 axis
26 follower roller
27 cam
28 spring
29 frame
30 shaft
31 follower roller
32 cam
34 spring
35 shaft
36 motor
38 sheet
38' leading sheet end

39 array of printing elements
40 sheet path
42 roller sections
43 yokes
44 shaft
45 sheet
46 margin
47 band
48 springs
49 driving rollers
a' unprinted margin
a printed margin

We claim:

1. A method for producing an image on a heat-sensitive sheet in a thermal printer, comprising the steps of:

(a) conveying the sheet on a rotatable, driven print drum having an outer drum surface and a direction of rotation, until a leading end of the sheet is in a first position, said first position being past a thermal head and prior to pressure means located after said thermal head in the direction of rotation of said drum said thermal head being in a rest position remote from the outer surface of said print drum, said rest position allowing the leading end of the sheet to pass freely between said thermal head and said drum;

(b) moving said thermal head to an operative position so as to urge the sheet against the outer surface of said print drum and to form a first contact line between the sheet and said thermal head adjacent the leading end of the sheet;

(c) pre-printing a margin onto the sheet, adjacent the leading end of the sheet, by line-wise heating said thermal head while further conveying the sheet until the leading end of the sheet is in a second position for engagement with said pressure means;

(d) deflecting the sheet towards said drum by said pressure means; and (e) image-wise printing onto the sheet by line-wise heating said thermal head, said image-wise printing being accomplished after deflection of the sheet by said pressure means, the deflected sheet contacting a portion of said outer drum surface and leaving said portion, in said direction of rotation, at a second contact line between the sheet and said outer drum surface, an angular frictional contact area being established between said drum and the sheet, said area being delimited by said first contact line and said second contact line.

2. The method according to claim 1, wherein step (e) comprises performing said image-wise printing such that said angular contact area extends over a distance, between the sheet and said print drum, of at least 10 mm.

3. The method according to claim 1, wherein step (e) is commenced as said pressure means is in its operative position.

4. The method according to claim 1, wherein said pressure means has an open position remote of said print drum and a closed position in which it urges the sheet in contact with said drum, said method further comprising the additional step of:

prior to step (d), moving said pressure means to said open position to allow the leading end of the sheet to freely extend between said pressure and said drum;

wherein step (d) includes moving said pressure means to said closed position.

5. The method according to claim 2, wherein step (c) is performed as said thermal head is in its operative position.

6. The method according to claim 2, wherein the thermal printer comprises control means for controlling the movements of said thermal head and of said pressure means, wherein:

step (b) comprises moving said thermal head from its rest to its operative position, under the command of said control means, to engage the sheet on said print drum; and step (d) is performed subsequently to step (b), and comprises operating said pressure means, under the command of said control means, to deflect the leading sheet end around said print drum.

7. The method according to claim 6, further comprising the additional step of maintaining said print drum at a standstill as the leading sheet end is introduced between said thermal head and said drum;

wherein said step of moving said thermal head from its rest to its operative position is subsequently performed so as to urge said thermal head towards said drum;

said method further comprising the additional steps of:

subsequently starting said drum to advance the sheet; and subsequently closing said pressure means to deflect the sheet.

8. The method according to claim 7, wherein said step of starting said print drum comprises rotating said print drum so as to advance the sheet over a distance of at least 5 mm before said pressure means is closed.

9. The method according to claim 8, wherein said step of starting said drum comprises rotating said drum so as to advance the sheet over a distance of at least 10 mm.

10. The method according to claim 1, wherein said pressure means is formed by roller means and wherein step (d) further comprises displacing said roller means towards said print drum in parallel relationship to said drum.

11. The method according to claim 3, further comprising the additional step of providing said roller means as a plurality of axially spaced roller sections.

12. The method according to claim 4, further comprising the additional step of individually biasing said roller sections by spring means towards said print drum.

* * * * *

UNITED STATES PATENT AND TRADEMARK OFFICE

CERTIFICATE OF CORRECTION

PATENT NO. : 5,954,440

DATED : September 21, 1999

INVENTOR(S) : Leys et al.

It is certified that error appears in the above-identified patent and that said Letters Patent is hereby corrected as shown below:

Column 8, line 11: "claim 2," should read -- claim 4, --;

Column 8, line 13: "claim 2," should read -- claim 4, --;

Column 8, line 49: "claim 3," should read -- claim 10, --;

Column 8, line 52: "claim 4," should read -- claim 11, --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*